United States Patent [19]

Mannbro

[11] 4,454,665

[45] Jun. 19, 1984

[54] ARRANGEMENT FOR ROTATING EQUIPMENT MOUNTED ON EXCAVATING MACHINES

[76] Inventor: Rolf Mannbro, Sextantgatan 2, 42176 Västra Frölunda, Sweden

[21] Appl. No.: 459,872

[22] PCT Filed: May 12, 1982

[86] PCT No.: PCT/SE82/00166

§ 371 Date: Jan. 10, 1983

§ 102(e) Date: Jan. 10, 1983

[87] PCT Pub. No.: WO82/04084

PCT Pub. Date: Nov. 25, 1982

[30] Foreign Application Priority Data

May 13, 1981 [SE] Sweden ..... 81029969

[51] Int. Cl.[3] ..... E02F 5/22

[52] U.S. Cl. ..... 37/103; 414/695.8

[58] Field of Search ..... 37/103, 117.5; 414/685, 414/687, 694, 722, 723, 710, 705, 695.8

[56] References Cited

U.S. PATENT DOCUMENTS 3,758,941 9/1973 Jackson et al. ..... 414/695.8

4,236,857 12/1980 Willi ..... 414/723

4,332,094 6/1982 Mieger ..... 414/723

FOREIGN PATENT DOCUMENTS 900098 7/1962 United Kingdom ..... 37/103

*Primary Examiner*—E. H. Eickholt

[57] ABSTRACT

Arrangement of equipment such as excavator buckets (1) mounted on excavating machines and similar machines, where the equipment is mounted on an attachment (7) provided for fastening to the machine arm by means of a shaft (8) in such a way that the equipment (1) can be rotated in relation to the attachment. The attachment (7) has a spigot (9) which is located eccentrically in relation to the shaft (8). The equipment (1) has a spigot (11) which is located some distance from the said rotating shaft. A first link (18) is swivel-mounted at the spigot (9) on the attachment and a second link (19) is swivel-mounted at the spigot on the equipment. At the ends which are not mounted on the said spigots the links are swivel-mounted to each other. The first link has a projecting portion (36), the end of which is attached to the said spigot (9) and which is arranged to penetrate to the rear of the said shaft (8) so that a larger angle of rotation in the direction concerned can be achieved before the link as such makes contact with the shaft (8).

3 Claims, 10 Drawing Figures

ARRANGEMENT FOR ROTATING EQUIPMENT MOUNTED ON EXCAVATING MACHINES

TECHNICAL FIELD

The present invention relates to an arrangement for equipment mounted on excavating machines and the like, such as excavator buckets, where the equipment is supported on an attachment provided for fastening purposes on the machine arm, by means of a shaft in such a way that the equipment can be rotated in the said shaft in relation to the attachment.

BACKGROUND

With machines for excavation and building works, such as excavating machines, tractors and the like carrying equipment, occasionally the need arises to forcibly rotate the equipment. If the rotation does not for example need to be greater than one quarter of a turn, the rotation can be performed with hydraulic servocylinders which are well known and are suitable force devices for such machines. Occasionally however further rotation is required, up to even a complete turn. This is the case particularly when working in tunnels or on steep slopes or walls, because it may be necessary to excavate or to lever both upwards, downwards and sideways.

TECHNICAL PROBLEM

When rotating equipment through angles which are not much less than half a turn, difficulties are encountered in bringing about rotation by means of an hydraulic cylinder which operates against a lever arm. Hence it has been necessary to resort to other solutions and it has proved difficult to find servo devices which in this sphere can replace the hydraulic cylinder. Rotating motors of different types require gearboxes and during the severe operating conditions encountered with equipment of this type these are highly stressed and at the same time are subjected to an unfavourable environment with considerable dirt and wetness. Hence, unless extremely advanced, robust constructions are employed, such arrangements have proved to have a short service life and low operational reliability and in many cases the difficulties have had to be accepted and arrangements have been employed in which rotation through larger angles is carried out by manual rotation after certain connections have been released.

THE SOLUTION

The solution in accordance with the invention involves the attachment for the equipment having a spigot which is located eccentrically in relation to the shaft and the equipment is provided with a spigot located at some distance from the said rotating shaft, where a first link is swivel mounted at the spigot on the attachment and a second link is swivel mounted at the spigot on the equipment. The links are swivel mounted to each other at the ends which are not mounted on the said spigots, the first link having a projecting portion, the end of which is attached at the said spigot and which is arranged to penetrate to the rear of the said shaft so that a larger rotational angle in the direction concerned is achieved before the link as a whole makes contact with the shaft.

ADVANTAGES

The invention provides a rotating arrangement for excavating machines and the like by means of which a rotational angle of at least almost a complete turn can be obtained without the aid of any rotating motor.

BRIEF DESCRIPTION OF DRAWINGS

Two embodiments of the invention are described in the following and illustrated in the appended drawings.

BEST MODE OF CARRYING OUT THE INVENTION

Figure 1:
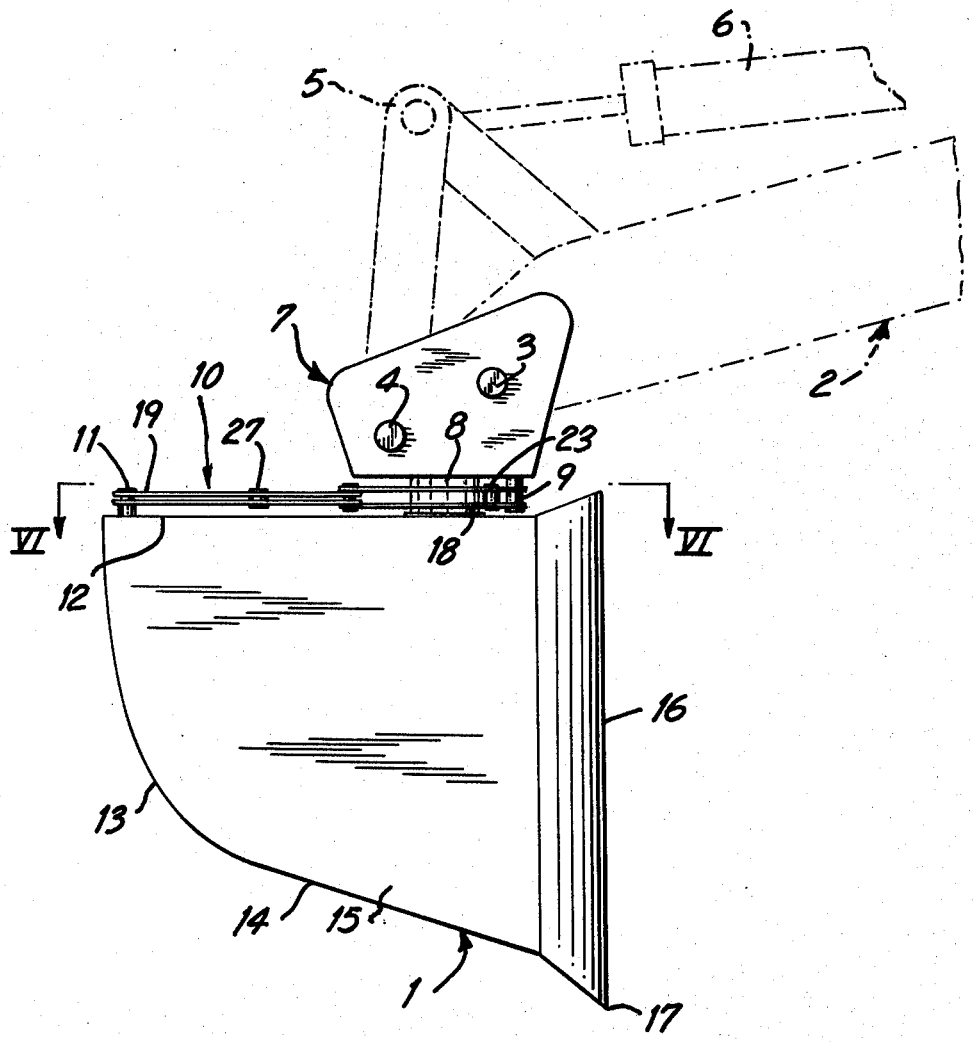
FIG. 1 gives a side view which relates to both embodiments.

FIG. 1 illustrates by means of continuous lines, in side view, an excavator bucket 1. This is arranged to be carried by an arm 2, denoted by dash-dotted lines on an excavating machine or the like. The bucket 1 is combined with the arm 2 by means of a shaft 3 and an attachment point 4 for a link system 5 so that the bucket can be swivelled through different angles in relation to the arm by means of an hydraulic servocylinder 6. The shafts 3 and 4 are mounted on an attachment 7 and this attachment in turn, by means of a shaft 8 which is at right angles to shafts 3 and 4, carries the bucket 1 in such a way that this can be rotated.

The attachment 7 is located to the rear of the line of intersection and hence is illustrated by dash-dotted lines in FIG. 2–10. The said diagrams also indicate the location of shafts 3 and 4.

As shown in the diagrams, the attachment supports a spigot 9 which is located some distance from shaft 8. Between this spigot 9 on attachment 7 a link system 10 extends to a spigot 11 which is attached to the bucket 1. The spigot 11 is fastened to the roof 12 of the bucket, which together with a rear wall 13, a base 14 and two ends 15 form all the walls of the bucket. In the centre of the rear wall 13 the bucket has an aperture 16 which is terminated at the base 14 by an excavating blade 17.

The link system 10 comprises two links, each of which is double, a first link 18 and a second link 19 which is surrounded by both halves of the first link 18. The link 18 is bent at right angles so that a projecting portion 36 which is mounted on the spigot 9 proceeds from the remaining portion 35 which connects with link 19. Link 19 is straight and is mounted at spigot 18. Both links are mounted side by side by means of a centre bearing 20.

The arrangement also comprises a first double-acting hydraulic servocylinder 21, the piston rod 22 of which is mounted between both halves of link 18 at a spigot 23. The cylinder is mounted in a bearing at a spigot 24 in the bucket roof 12. A second double-acting hydraulic servocylinder 25 has a piston rod 26 which by means of a spigot 27 is mounted between both halves of link 19. Here too the cylinder is mounted in a bearing at the bucket roof 12 and by means of a spigot 28. The servocylinders 21 and 25 are not shown in FIG. 1 so as to increase clarity.

Figure 8:
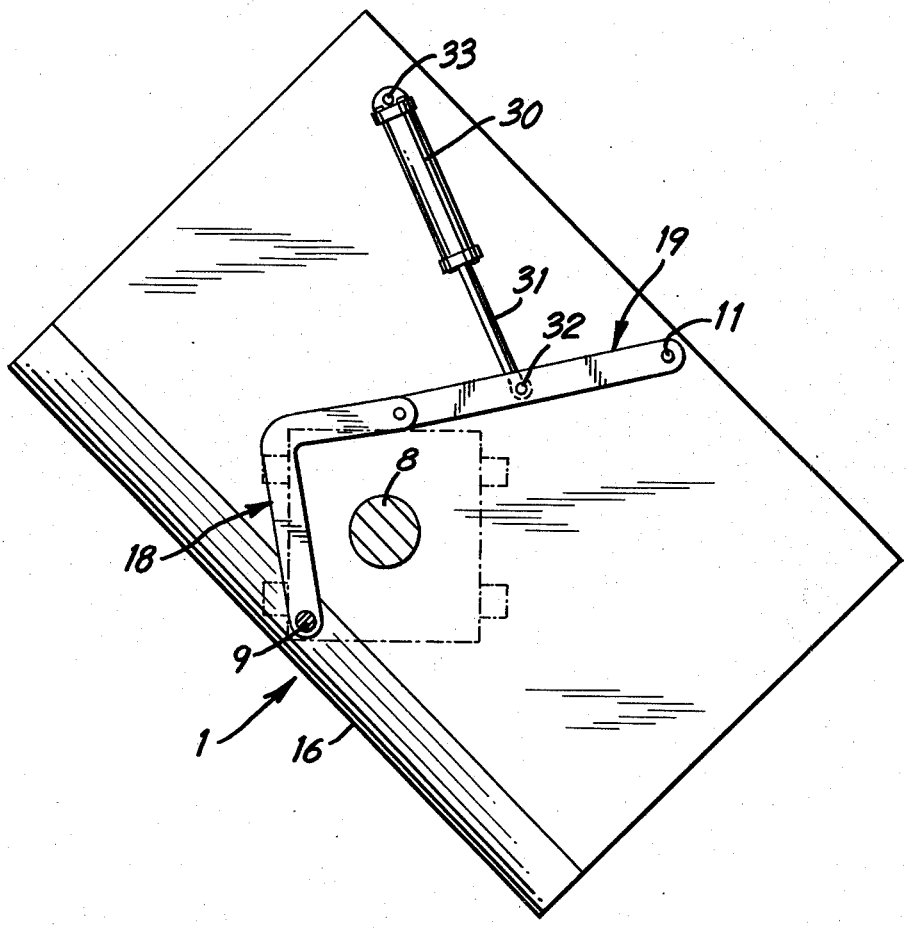
FIG. 8–10 illustrate the second embodiment in a corresponding section.
Figure 9:
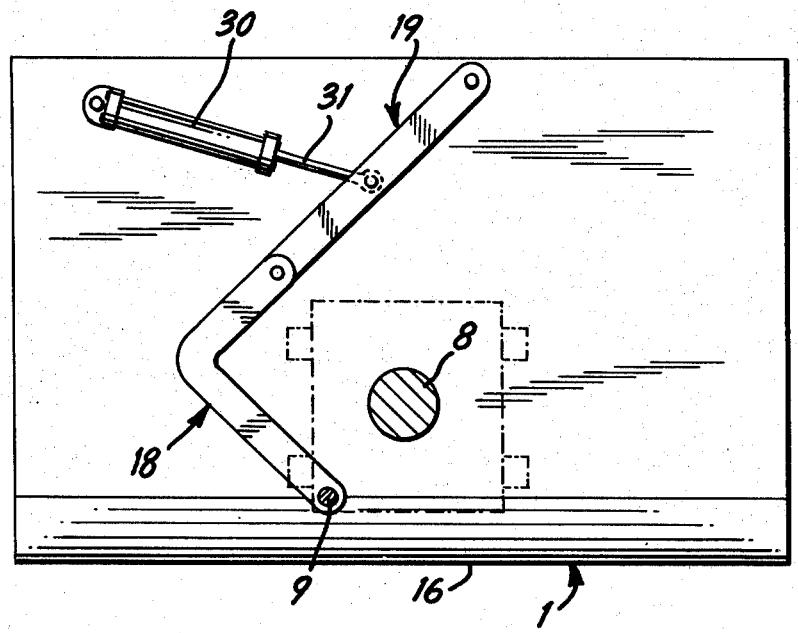
Figure 10:
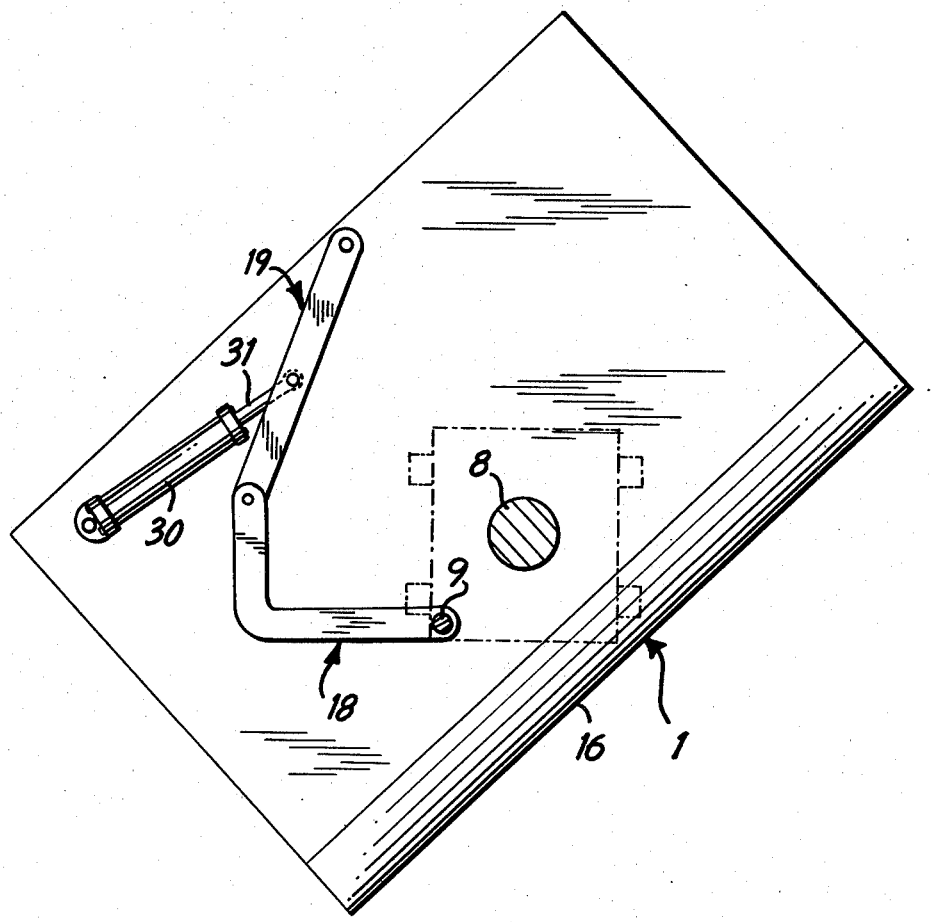

In the embodiment shown in FIG. 8–10 the same components are present as have just been described. However the two hydraulic servocylinders 21 and 25 are here replaced by a single double-acting cylinder 30, the piston rod 31 of which is mounted at a spigot 32 between both halves of link 19. Here the cylinder is mounted at the bucket roof 12 by means of a spigot 33.

In the first embodiment the two servocylinders are arranged so that they operate in a certain, inter-related cycle whilst bringing about rotation of the bucket 1, this cycle comprising the extension and retraction of the respective piston rods. If it is assumed that the excavating machine arm is in the position shown in FIG. 1, then the shaft 8 is essentially vertical. The arm then extends downwards, see FIG. 2–10, i.e. in actual fact it is essentially horizontal, whilst the bucket roof, in accordance with FIG. 1, shown in these diagrams is assumed to be horizontal.

Figure 2:
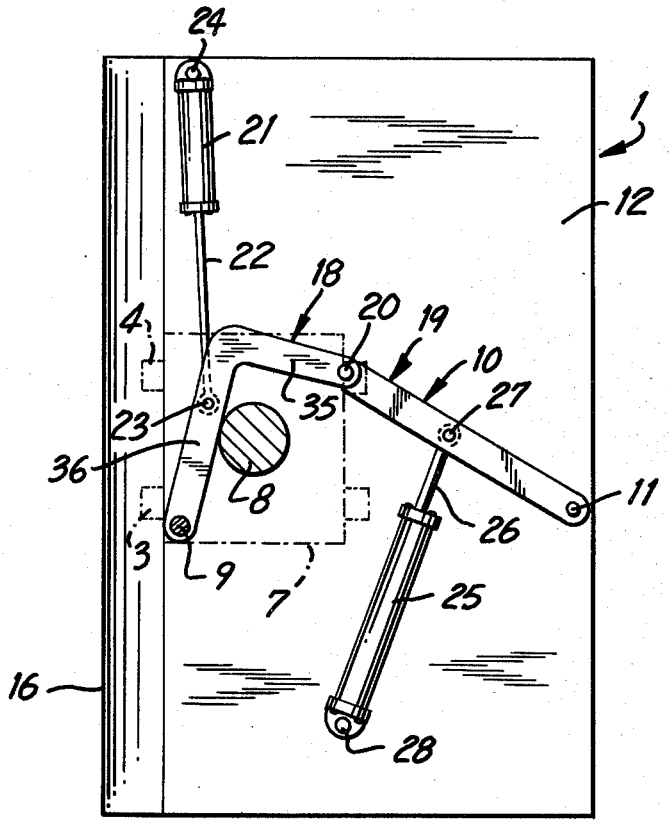
FIG. 2–7 illustrate different working positions of the arrangement in accordance with the first embodiment in a section along the line VI—VI and in six different working positions (the position in FIG. 1 corresponds approximately with the position in FIG. 6)
Figure 3:
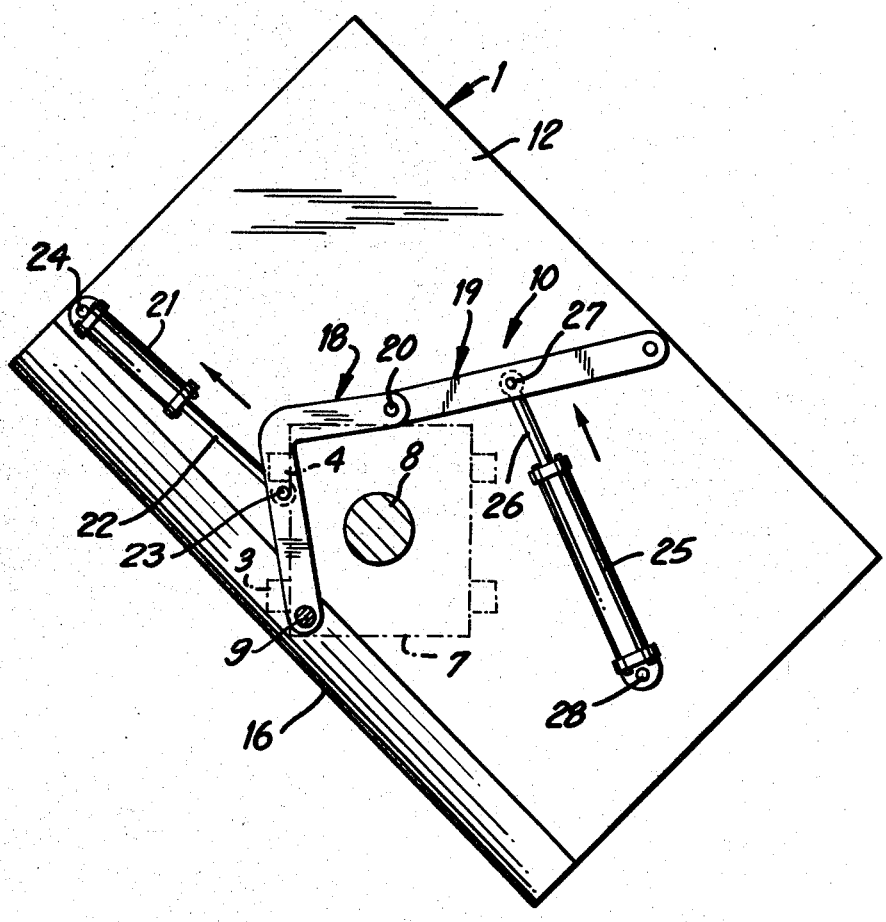
Figure 4:
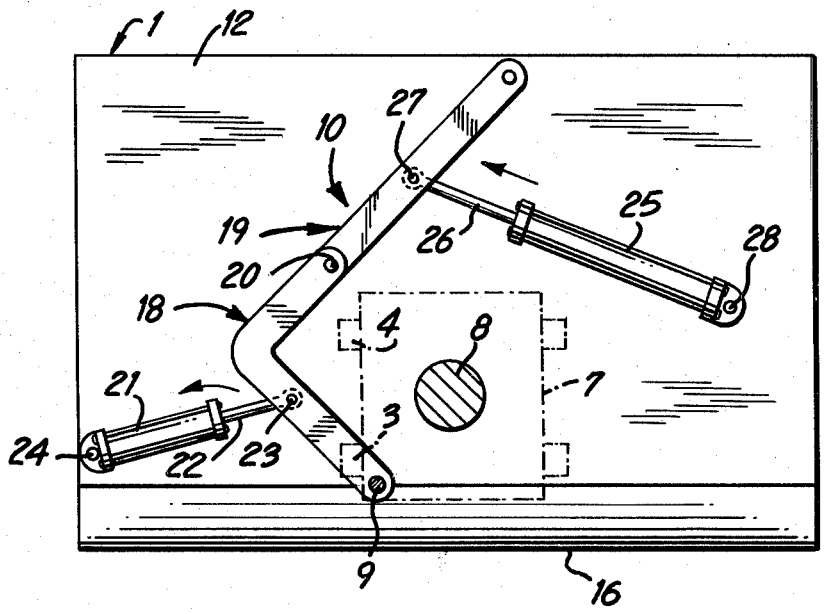

In the position illustrated in FIG. 2 the bucket aperture 16 thus points to the left, based on the view of the person observing the diagram, who can be regarded as being in the same position as the driver of the machine from which the arm 2 is assumed to proceed. Hence it is possible to excavate by swinging the machine sideways in this bucket position. By retracting the piston rod 22 of cylinder 21 and extending piston rod 26 of cylinder 25 the bucket can be made to rotate so that the bucket aperture is orientated increasingly towards the machine. By hydraulic locking of the double-acting hydraulic cylinders the bucket can be clamped in any rotational position. FIG. 3 illustrates approximately the 45° position from the left-orientated position in FIG. 2. In FIG. 4, by continued retraction of piston rod 22 and extension of piston rod 26, the bucket has been rotated so that its aperture points straight towards the machine. This is a normal operating position in which excavation can be carried out by swinging the arm with the bucket aperture towards the machine. Emptying can take place by raising the bucket and swinging it outwards so that the bucket aperture points downwards.

Figure 5:
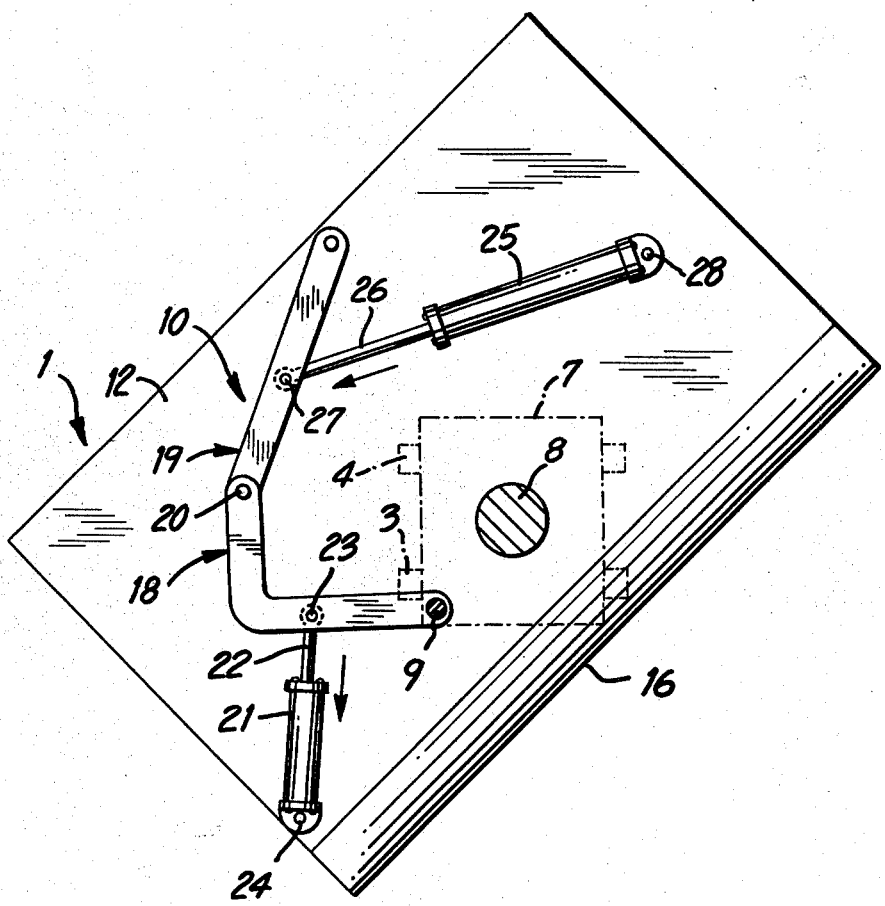
Figure 6:
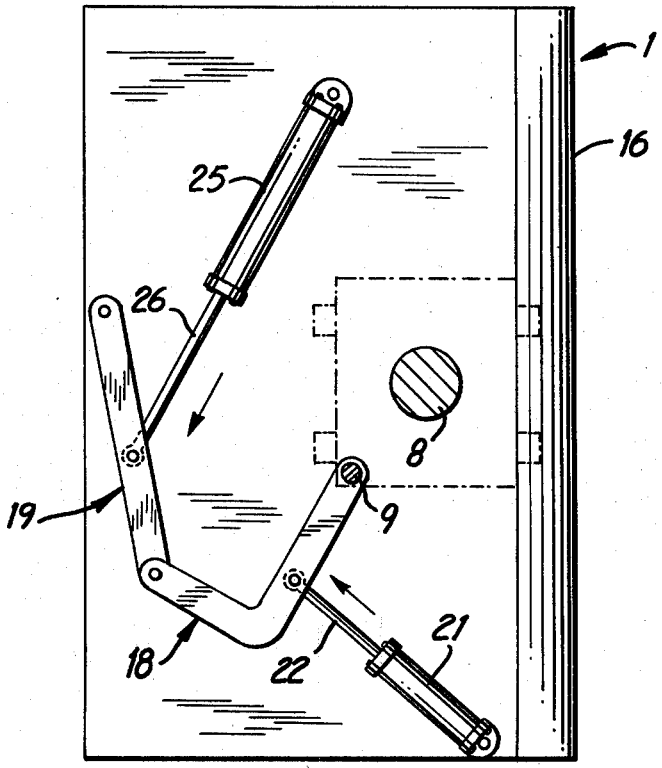
Figure 7:
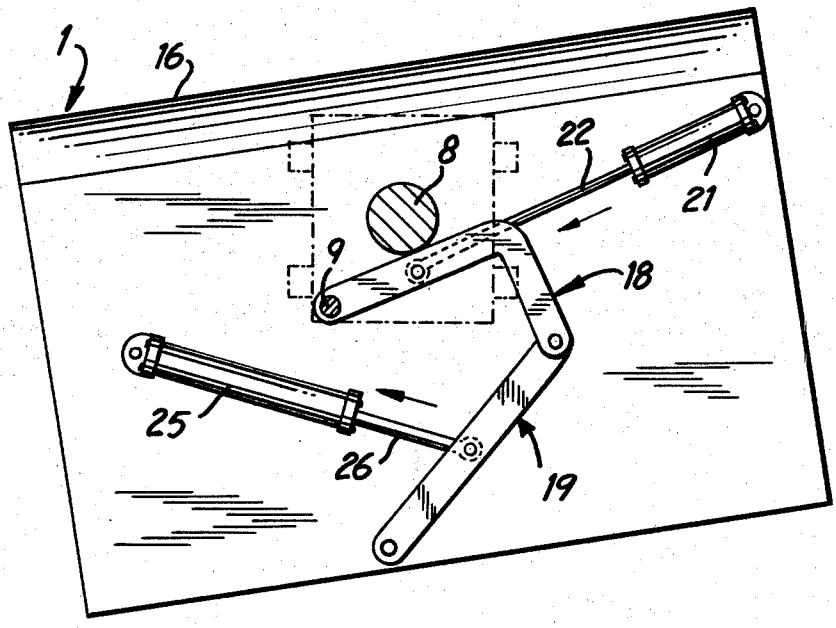

FIG. 5 shows how the bucket has been allowed to rotate further, circa 45°, by further retraction of piston rod 22 and by further extension of piston rod 26. The piston rod 22 has now just about reached its most inward position and must now reverse its movement whilst piston rod 26 continues its outward movement. The "dead points" for the two cylinders thus do not coincide, which facilitates a continuous rotary movement on the part of the bucket without any uncertainty arising at the reversal points of the cylinders. In FIG. 6 a purely sideways right hand position for the bucket aperture 16 has been obtained and as shown by the diagram the piston rod 22 has reversed its movement whilst piston rod 26 is still being extended. The next position is shown in FIG. 7 and this represents the extreme position in this direction of movement (in the diagrams the bucket has been rotated anticlockwise). Here the bucket has passed the purely outwardly facing direction for the bucket aperture 16. Right up to this position from the preceding one the piston rod 22 is pushd outwards all the time whilst piston rod 26 has reversed and towards the end of the rotational movement it performs an inwardly directed movement in the cylinder.

As shown in FIG. 2 and 7, the limit for the movement is imposed by the positions in which the link 18 rests against the shaft 8. Between these extreme positons the rotation exceeds 270°. This has been achieved by a co-ordinated movement on the part of the two servocylinders. The movement of this cylinder can be regarded as complying with the following table:

| Rotational sector for bucket aperture 16 | Piston rod 22 in cylinder 21 | Piston rod 26 in cylinder 25 |
|---|---|---|
| From left position (FIG. 2) to 45° towards left (FIG. 3) | In | Out |
| From 45° towards left (FIG. 3) in towards machine (FIG. 4) | In | Out |
| From towards machine (FIG. 4) to 45° towards right (FIG. 5) | In | Out |
| From 45° towards right (FIG. 5) to right hand position (FIG. 6) | Reverses from in to out | Out |
| From right hand position (FIG. 6) to from machine (FIG. 7) | Out | Reverses from out to in |

For performing this cycle of movements it is advisable to provide automatic devices which reverse the movement of the piston rod when this has reached its respective pre-determined extreme positions. The person actuating the arrangement then needs only to open one of two valves, which govern the inlet side of the hydraulic medium in a certain rotational position of the bucket, so that by this means the direction of rotation can be reversed. Hence the said extreme position valves must be change-over valves so that during the desired movement in one of the directions both of the cylinders receive pressure mdium on the correct side of the piston dependent on the instantaneous rotational position at the moment of starting and the desired direction of rotation.

FIG. 8–10 illustrate an alternative where only one servocylinder is provided. The three positions in FIG. 8–10 show that a more restricted movement can be achieved with only one cylinder as it is not possible to pass the dead points of the links. If the dead points were to be reached with only one cylinder, and if in order to pass the dead point the direction of movement of the cylinder were to be reversed, then at the dead point either a locking action or an indefinite movement would be encountered and it would not be possible to establish in which direction rotation would continue. It is thus possible to overcome such dead points by using two cylinders which operate out of phase with each other so that they do not reverse simultaneously. However it has been proved that with the arrangement shown in FIG. 8–10 employing only one cylinder it is possible to achieve a total rotational movement of 170°with the arrangement illustrated using two links, of which one is bent at an angle.

INDUSTRIAL APPLICABILITY

It should be noted that the arrangement illustrated presupposes that it is necessary to have a continuous shaft, shaft 8. Consequently in the extreme positions some of the links will come into contact with the shaft and this represents the extreme rotational positions. Hence the arrangement does not relate to those arrangements where a cam shaft or the like can pass the centre of the shaft, an arrangement which for strength reasons is not practically feasible for the sphere of application envisaged here.

The arrangement illustrated is particularly suitable for excavator buckets, but is can conceivably also be employed with other equipment of sufficient size to accommodate the rotating mechanism. An example of such equipment could be excavator blades.

I claim:

1. Arrangement for equipment mounted on excavating machines and similar machines, such as excavator buckets (1), where the equipment is mounted on an attachment (7) provided for fastening on the equipment arm (2) of the machine by means of a shaft (8) in such a way that the equipment (1) can be rotated in relation to the attachment in the said shaft, characterised in that the attachment (7) has a spigot (9) which is located eccentrically in relation to the shaft (8) and that the equipment (1) has a spigot (11) located at a distance from the said rotating shaft, where a first link (18) is swivel-mounted at spigot (9) on the attachment and a second link (19) is swivel-mounted at the spigot on the equipment, the ends of the said links which are not mounted at the said spigots being swivel-mounted to each other, the first link having a projecting portion (36), the end of which is attached to the said spigot (9) and which is arranged to penetrate behind the said shaft (8) so that the angle of rotation in the direction concerned is extended before the link otherwise makes contact with the shaft (8).

2. Arrangement as in patent claim 1, characterised in that a single servocylinder (30,31) is provided for rotation and which is attached firstly to the equipment (1) and secondly to the second link (19) so that this can be swivelled and take with it the first link (18) so that the equipment is rotated relative to the attachment (7) with its spigot (9).

3. Arrangement as in patent claim 1, characterised in that a doubleacting servocylinder (21, 25) is connected to each of the links (18,19), which cylinders are so located and connected to the links that with a view to reaching their respective end points of the stroke of piston rod (22, 26) they operate out of phase with each other, and the cylinders are so connected to a control system that they reverse their dirction of movement at the respective stroke end points, so that by bridging over the end points of each cylinder by means of continued movement on the part of the other cylinder the rotational movement can be continued beyond the respective end points within a rotational sector of approximately 360°.

* * * * *